United States Patent [19]

Higgins

[11] 4,330,490

[45] May 18, 1982

[54] METERING DEVICE

[75] Inventor: Gerald V. Higgins, Los Angeles, Calif.

[73] Assignee: Seymour J. Kurtz, Chicago, Ill. ; a part interest

[21] Appl. No.: 212,824

[22] Filed: Dec. 4, 1980

[51] Int. Cl.[3] ..... B01F 3/04

[52] U.S. Cl. ..... 261/62; 118/323; 239/329; 239/332; 239/338; 239/434; 261/78 A

[58] Field of Search ..... 261/78 A, 62, 121 R, 261/DIG. 27, DIG. 65; 239/329, 331, 332, 338, 434; 118/323

[56] References Cited

U.S. PATENT DOCUMENTS

| | | | |
|---|---|---|---|
| 1,828,183 | 10/1931 | Grant . | |
| 2,136,668 | 11/1938 | Binder | 91/12.2 |
| 2,230,342 | 2/1941 | Zabban | 239/338 |
| 2,342,602 | 2/1944 | Reitz, Jr. | 261/DIG. 47 |
| 3,116,348 | 12/1963 | Walker | 261/62 X |
| 3,286,790 | 11/1966 | Kestel | 239/332 X |
| 3,294,058 | 12/1966 | Shriro | 118/323 X |
| 3,519,100 | 7/1970 | Semon | 261/78 A X |
| 4,231,973 | 11/1980 | Young et al. | 239/338 X |

*Primary Examiner*—Richard L. Chiesa

*Attorney, Agent, or Firm*—Marshall A. Lerner

[57] ABSTRACT

A metering device for providing fine control of the movement of a capillary tube and hence the rate of aspiration of a fluid flowing through the tube is disclosed. A reduction gear is threadedly mounted in a housing and has an internal threaded bore. An elongated member which holds the capillary tube with the aid of a vice or collet is threaded into the internal bore of the reduction gear. The number of threads per unit axial length on the outside threaded surface of the reduction gear, which surface is threaded into the housing, is different from the number of threads per unit axial length on the internal bore. This provides the reduction gear effect to thereby provide longitudinal displacement of the elongated member as well as the capillary tube in linear proportion to the rotational displacement of the reduction gear. The housing has a pin which is adapted to be inserted in a groove in a nuthead of the elongated member to maintain the elongated member rotationally stationary with respect to the housing. This enables the capillary tube which is secured to the elongated member to move longitudinally and respond to a rotational displacement of the reduction gear while remaining rotationally stationary around its axis.

16 Claims, 5 Drawing Figures

METERING DEVICE

BACKGROUND OF THE INVENTION

1. Field of the Invention

The present invention relates to a metering device and more particularly to a device for providing fine control of the movement of a capillary tube. The invention provides very fine control of the rate of aspiration of a fluid flowing through the capillary tip.

2. Background of the Invention

In the field of devices for controlling the aspiration rate of a fluid, it is common to use a capillary tube through which fluid is drawn by an air stream under pressure which creates a vacuum. Such devices operate on the Venturi Principle wherein a stream of air is vented at a predetermined pressure level at the capillary tip in a direction perpendicular to the axis of the capillary tube. The opposite end of the capillary tube is injected into a solution. When the air stream passes the capillary tip, it creates a vacuum which draws the fluid through the capillary tube and aspirates it.

Such devices are typically used in flame photometers such as the kind manufactured by Instrumentation Laboratory Company. In such devices, the capillary tube is fixedly attached to a holding device which is threaded through a bore in a plexiglass chamber. The capillary tube is injected into a solution, such as a sodium potassium solution, which is intended to be aspirated in a chamber. The other end of the capillary tube, the capillary tip is positioned in close proximity to a source of air pressure which vents the air stream in the direction of the capillary tip at a right angle to the axis of the capillary tube. The air stream creates a vacuum which draws the solution through the capillary tube and out the capillary tip in atomized form in a chamber.

Optimum operation of such flame photometers requires an aspiration rate of one mililiter per 40 second ±5 second. In order to adjust the aspiration rate, the holding device having the capillary tube fixedly secured to it is rotated in the threaded bore of the chamber. This however, does not provide fine control of the lineal distance from the capillary tip to the output port of the source of the air current.

This is caused by the machining tolerances of the threads in the bore of the plexiglass chamber. This prevents the holding device and capillary tube from moving in perfect perpendicular alignment with the direction of the air stream. In such devices, turning the holding device, which holds the capillary tube, one or two degrees can change the aspiration rate by as much as 15 seconds. Thus such devices lack fine control of lineal displacement between the capillary tip and the air stream as a function of the rotational displacement of the holding device in the threaded bore of the plexiglass chamber. They therefore do not enable a user to closely control the aspiration rate of fluid flowing through the capillary tip.

A second problem inherent in such devices is caused by the rotation of the capillary tube about its axis as the holding device is rotated in the threads of the bore of the chamber. As the elongated member is rotated slightly the capillary tip which is fixedly attached to it rotates around its axis while at the same time moving closer to or farther away from the source of the air stream. The capillary tip thereby rotates in a circular pattern in a plane perpendicular to the axis of the capillary tube. This further detracts from the linearity of the movement of the capillary tip with respect to the direction of the air stream when the holding device which holds the capillary tube is rotated. Thus, these prior art devices do not enable a user to control in a very accurate manner the rate of aspiration of fluid in the chamber of the aspirator bowl.

Other prior art devices also seek to control the rate of aspiration of a solution. One such device is shown in U.S. Pat. No. 3,294,058 to Shriro. The Shriro Patent discloses a device for providing a fine spray which is drawn through a nozzle by a current of gas under high pressure. The position of the nozzle with respect to the orifice through which the source of gas under high pressure is vented is controlled by the movement of a mechanism which is threaded through a bore. The nozzle source therefore rotates longitudinally. This longitudinal rotation of the nozzle source, in order to adjust the distance between it and the source of high pressure gas, causes the same problems inherent in the flame photometers of the Instrumentation Laboratory Company described above. Thus, the Shriro device lacks fine control of the distance between the nozzle source of fluid to be aspirated and the source of high pressure gas and therefore lacks fine control of the rate of aspiration.

SUMMARY OF THE INVENTION

The present invention eliminates the problem of inadequate fine control of a movement of the capillary tip. The invention further maintains the capillary tube rotationally stationary while permitting longitudinal movement of the capillary tube with respect to the source of air pressure.

This is achieved by providing an elongated member for holding the capillary tube and a reduction gear means which couples the elongated member to a housing which is fixedly attached to the aspirator bowl.

The elongated member has a central axis or bore which is adapted for holding the capillary tube in the central axis. The elongated member also has an outer threaded surface which is adapted to be threaded into an inner threaded bore of the reduction gear. The reduction gear has an outer threaded surface which is adapted to be threaded into an interior threaded bore of the housing.

The number of threads per unit axial length on the outside of the reduction gear is different from the number of threads per unit axial length on the inside of the reduction gear. The differential in number of threads provides a reduction gear effect. This enables a relatively large rotational displacement of the reduction gear to move the capillary tube a relatively small distance to thereby provide very fine control of the movement of the capillary tube.

The elongated member in the preferred embodiment includes a nut having a head with a groove in it. The housing has a suitable securing means which in the preferred embodiment is in the form of a pin, which is inserted in the groove in the nut head to thereby maintain the elongated member rotationally stationary with respect to the housing while it is being moved longitudinally by the rotation of the reduction gear. The elongated member has the capillary tube fixedly secured within its central axis by a suitable vice such as a collet chuck. Thus, when the reduction gear is rotated, the elongated member and the capillary tube move longitudinally without any rotation of the capillary tube around its axis. This enables adjustment of the displacement of the capillary tip with respect to the vent of the high pressure air or gas stream while at the same time avoiding any lateral movement of the capillary tip which results in nonlinear flow dynamics of the fluid transmitted through the capillary tube.

In the preferred embodiment the housing includes means for securing the housing to the chamber of the plexiglass atomizing bowl. This is achieved by providing an extended tubular member which is fixedly attached to the housing and which has an outer threaded surface. The plexiglass housing has a threaded bore and the extended tubular member is threaded into it. The housing is thereby fixedly secured to the plexiglass atomizing bowl.

The tubular member has a hollow axial bore through its central axis. The capillary tube is inserted in the axial bore of the extended tubular member with the tip of the capillary tube extending beyond the end of the tubular member to thereby enable flow of fluid through the capillary tube into the chamber of the atomizing ball.

Accordingly, it is an object of the present invention to provide fine control of the movement of the capillary tube.

Another object is to provide reduction gear means to provide a reduction gear effect to control in a very fine manner the longitudinal movement of a capillary tube.

Still another object of the present invention is to provide means to enable a capillary tube to be moved longitudinally with respect to its axis while remaining rotationally stationary.

Other objects, advantages and novel features of present invention will become apparent from the following detailed description of the invention when considered in conjunction with the accompanying drawings.

DESCRIPTION OF THE PREFERRED EMBODIMENT

Figure 1:
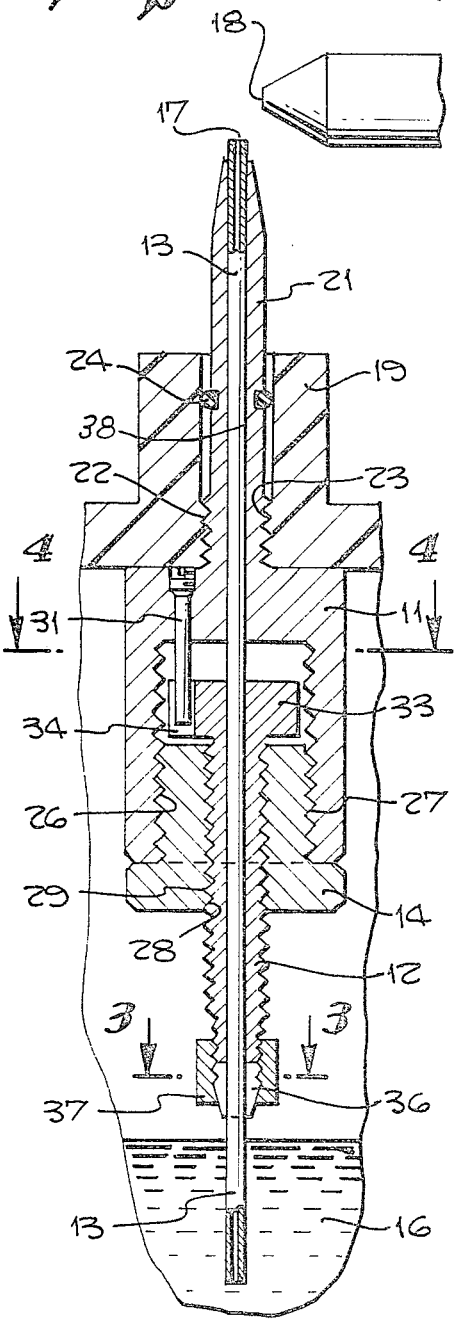
FIG. 1 is a vertical cross-sectional view of the apparatus of the present invention.
Figure 2:
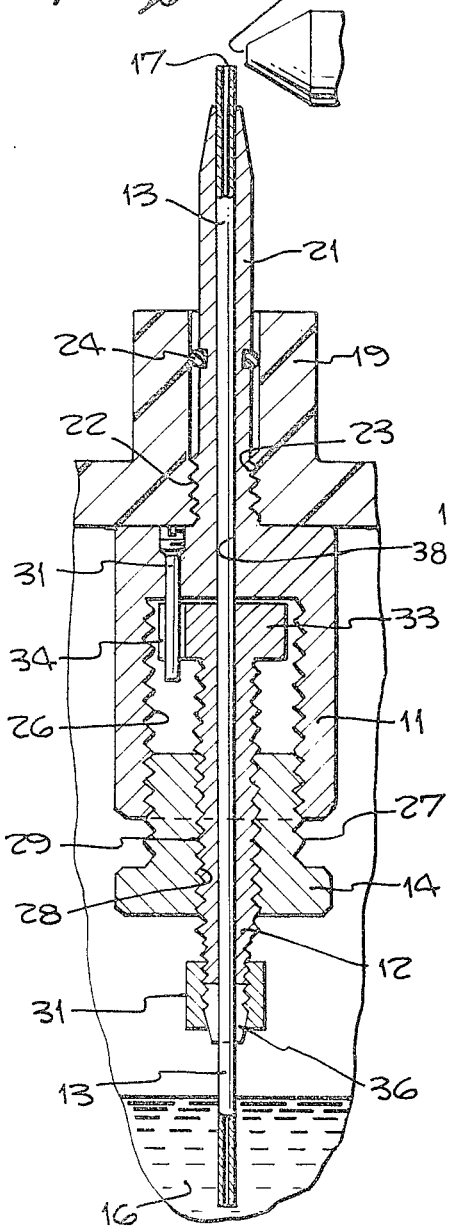
FIG. 2 is a vertical cross-sectional view of the apparatus of the present invention with the reduction gear displaced from the position shown in FIG. 1.

Referring to FIGS. 1 and 2, there is shown the metering device of the present invention having a housing 11 and an elongated member 12 for holding a capillary tube 13. Displacing means in the form of reduction gear means 14 is coupled between the housing 11 and the elongated member 12 for providing fine control of the movement of the elongated member 12.

The metering device of the present invention has numerous applications. The preferred embodiment is used to provide fine control of the rate of aspiration of a fluid 16 which is transmitted through the capillary tube 13 by a Venturi effect created by a flow of air or gas which is vented from an orifice 18 which is in close proximity to the capillary tip 17. The fluid is thereby atomized in the internal chamber of an atomizing bowl 19 to which the housing is secured.

The securing of the housing to the atomizing bowl is achieved by an extended tubular member 21 which is formed as an integral portion of the housing 11. The tubular member 21 has a threaded outer surface 22 shown in FIGS. 1, 2 and 5 and the atomizing bowl 19 has a threaded bore 23 in which the tubular member 21 is threaded at threads 22 to permanently secure the housing 11 to the atomizing bowl 19 and its internal chamber. An O-Ring 24 provides further sealing to prevent any atomized spray in the internal chamber of the atomizing bowl from escaping through the bore 23.

The reduction gear 14 has an outer threaded surface 27 adapted to be threaded into an interior threaded bore 26 of the housing 11. The number of threads per unit axial length on the outer threaded surface 27 of the reduction gear 14 is equal to the number of threads per unit axial length of the interior bore 26 to thereby enable the reduction gear 14 to be threaded into the threaded interior bore 26.

Figure 5:
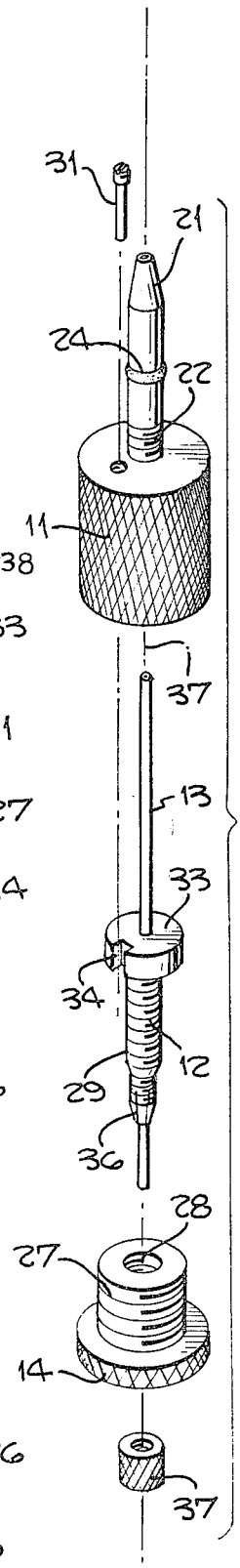
FIG. 5 is an exploded perspective view of the present invention.

The reduction gear 14 also has a threaded interior bore 28 as shown in FIGS. 1, 2 and 5. The elongated member 12 has an outer threaded surface 29 having a number of threads per unit axial length equal to the number of threads per unit axial length on the threaded interior bore 28 of the reduction gear. The elongated member 12 is thereby adapted to be threaded into the threaded interior bore 28 of the reduction gear 14.

The number of threads per unit axial length on the outer threaded surface 27 of the reduction gear 14 is different from the number of threads per unit axial length on the threaded interior bore 28 of the reduction gear. This provides a reduction gear effect to enable displacement of the elongated member 12 in response to rotation of the reduction gear 14. Rotation of the reduction gear 14 may be done manually by grasping the lower nuthead. Alternatively, it may be rotated by coupling the nuthead to a suitable motor device (not shown) to provide motorized control of the rotation gear 14.

If the number of threads per unit length on the outer threaded surface 27 of the reduction gear 14 is greater than the number of threads per unit length on the interior threaded bore 28 of the reduction gear 14, the rotation of the gear 14 upwardly will cause the elongated member 12, as well as the capillary tube secured to it, to move downwardly. This linear ratio of a greater number of outer threads to inner threads on the reduction gear 14 is shown in the embodiment in FIGS. 1 and 2. As shown in FIG. 1, when the reduction gear 14 is at its uppermost extreme, the elongated member 12 is at its lowermost extreme. As shown in FIG. 2 when the reduction gear 14 is rotated so that it is vertically lower, the elongated member 12, and the capillary tube 13 secured to it, are moved upwardly.

Correspondingly, if the threads per unit length on the outer threaded surface 29 is less than the threads per unit length on the threaded interior bore 28, rotation of the reduction gear 14 upwardly will cause the elongated member 12 in the capillary tube 13 to move upwardly. This construction is in one embodiment of the invention wherein the number of outer threads per unit length of the reduction gear 14 is less than the number of inner threads per unit length of the reduction gear 14 (not shown), wherein the outer surface has 28 threads per inch and the interior threaded surface has 32 threads per inch. Accordingly, if the reduction gear 14 is rotated one revolution, it moves either upwardly or downwardly 1/28th of an inch or 0.036 inches. Similarly, the rotation of the reduction gear 14 one revolution causes the elongated member to move 1/32nd of an inch or 0.031 inches. If the reduction gear 14 is rotated one revolution upwardly it will move 0.036 inches upwardly. Correspondently, it will cause the elongated member 12 to move 0.031 inches downwardly. The net effect is to cause the movement of the elongated member 12 as follows:

Movement of reduction gear: 0.036 inches up
Movement of elongated member: 0.031 inches down
Net movement of the elongated member: 0.005 inches up Thus in the example above, one rotation of the reduction gear 14 causes displacement of 0.005 inches of the elongated member. Therefore, the close control of the movement of the elongated member may be achieved by rotation of the reduction gear 14.

In an alternative embodiment (not shown) the outer threaded surface 27 of the reduction gear 14 has 32 threads per inch and the threaded interior bore 28 has 36 threads per inch. In this embodiment, the rotation of the reduction gear one revolution causes a displacement of 1/32nd of an inch or 0.031 inches. The rotation of the reduction gear 14 one revolution correspondingly causes a displacement in the opposite direction of 1/36th of an inch or 0.028 inches. Thus, if the reduction gear is rotated one revolution upwardly, the net effect is:

Movement of reduction gear: 0.031 inches up
Movement of elongated member: 0.028 inches down
Net movement of elongated member: 0.003 inches up Thus the differential between the number of threads per unit length on the outer threaded surface 27 with respect to the number of threads per unit length on the interior bore 28 determines the relative movement of the elongated member and the capillary tube with respect to rotation of the reduction gear 14. It is thus seen that by adjusting the differential in the number of threads per unit length, the movement of the enlongated member and the capillary may be adjusted to provide very fine control of the movement of the capillary tube with respect to the rotation of the reduction gear. This in turn provides very fine control of the distance between the capillary tip 17 and the output port 18 to thereby provide fine control of the rate of aspiration of fluid transmitted through the capillary tube 13 into the internal chamber of the atomizing bowl 19.

The elongated member 12 is adapted to be engaged by securing means in the form of a pin 31 shown in FIGS. 1, 2 and 5. This construction enables the elongated member 12 to move longitudinally with respect to the central axis or bore 32 of the capillary tube while retaining it rotationally stationary with respect to the central axis 32. This, in turn, renders the elongated member 12 rotationally stationary with respect to the housing 11.

Figure 4:
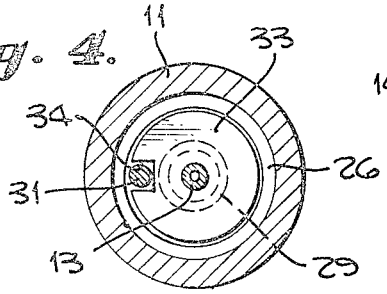
FIG. 4 is a cross-sectional view of FIG. 1 taken along the line 4—4 of FIG. 1.

The elongated member 12 includes a nut having a head with a groove 34 as shown in FIGS. 4 and 5. When the nuthead 33 is inserted into the threaded interior bore 26 of the housing 11, it is positioned so that the pin 31 is inserted into the groove 34.

Figure 3:
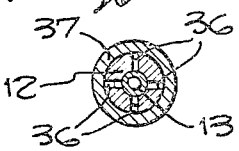
FIG. 3 is a cross-sectional view of FIG. 1 taken along the line 3—3 of FIG. 1.

The capillary tube 13 is inserted through the central axis 32 of the elongated member. The lower portion of the elongated member has four notches 36 as shown in FIGS. 3 and 5. A suitable vice 37 may be threaded onto the lower portion of the elongated member 12 to secure the capillary tube 13 to the elongated member 12 to ensure coincidential movement of the elongated member 12 and the capillary tube 13.

Thus, as shown in FIGS. 1 and 2, the elongated member moves up or down linearly in response to rotational displacement of the reduction gear 14. The pin 31 prevents it from rotating it around the axis 32 while permitting it to move longitudinally with respect to the axis 32.

It will thus be seen that the construction of the present invention with the pin 31 maintaining the elongated member 12 and the capillary tube 13 rotationally stationary enables the movement of the capillary tube 13 logitudinally along its central axis 32 while preventing the capillary tube 13 from rotating around the central axis 32. This provides a substantial benefit over similarly employed prior art devices which provide for a holding device to which the capillary tube is secured which is threaded into a bore such as bore 23 in the plexiglass atomizing ball.

In typical prior art devices, the holding device, which is analogous to the extended tubular member 21, is threaded into the bore in the plexiglass atomizing ball and rotated to change the lineal displacement between the capillary tip 17 and output port 18. The machining tolerances and the threads of the holding device do not provide perfect alignment of the capillary tube with respect to the output port. In such devices, as the holding device, with the capillary tubes secured to it, is rotated, the capillary tip rotates, to a small extent, laterally. Thus, the movement of the capillary tube, in such prior art devices, logitudinally does not enable linear control of the rate of aspiration with respect to the longitudinal movement of the capillary tube. This results in nonlinear flow dynamics of the fluid which is transmitted out of the capillary tip 17 and therefore leads to a monlinear vacuum. This problem is eliminated by the present invention by the construction of the pin 31 which is arranged to be inserted into the groove 34 to enable longitudinal movement of the capillary tube 13 along the axis 32 while preventing rotation of the capillary tube 13 around the axis 32.

In the assembly of the present invention, the capillary tube 13 is preferably inserted into the central axis of the elongated member 12. The tube 13 is then inserted through a bore 38 through the central axis of the extended tubular member 21. The nuthead 33 is then positioned so that the pin 31 is inserted through the groove 34. The reduction gear 14 is then threaded into the interior bore of the housing 11.

Lastly, the vice 37 is threaded onto the lower portion of the elongated member 12 and urges the notched ends against the capillary tube 13 to secure it to the elongated member to ensure coincidental movement of the elongated member with the capillary tube.

It will thus be seen that the present invention provides a metering device which provides fine control of the movement of the capillary tube to control the rate of aspiration of fluid in the aspirator bowl. Furthermore, the invention prevents lateral movement of the capillary tip with respect to the output port 18 of the air (or gas) which creates the Venturi effect to cause the fluid 16 to be transmitted through the capillary tube 13 and out the capillary tip 17 into the chamber of the atomizing ball.

Obviously, many modifications and variations of the present invention are possible in light of the above teachings. For example, although the invention is described as a device for controlling the rate of aspiration of a fluid through a capillary tip, the teachings of the present invention may be applied to fine control of the rate of aspiration of a gas or granular solid.

In addition, the teachings of the present invention may be applied to provide fine control of the displacement of any tube or rod with respect to a fixed point in the housing or structure which holds the tube or rod. It will be seen that a solid cylindrical rod may be substituted for the tube described in the present invention. The present invention may be used to control the displacement of any such rod. It is therefore to be understood that within the scope of the appended claims, the invention may be practiced otherwise then as specifically described.

I claim:

1. A metering device for providing fine control of the movement of a tube comprising:

housing means including a threaded interior bore;

an elongated member for holding the tube, said elongated member having an outer threaded surface; and reduction gear means having a threaded interior bore, and coupled between said housing means and said elongated member, said reduction gear means having an outer threaded surface having a number of threads per unit axial length equal to the number of threads per unit axial length on said threaded interior bore of said housing means to thereby be adapted to be threaded into said threaded interior bore of said housing means;

said elongated member having on said outer threaded surface thereof a number of threads per unit axial length equal to the number of threads per unit axial length on said threaded interior bore of said reduction gear means to thereby be adapted to be threaded into said threaded interior bore of said reduction gear means;

wherein the number of threads per unit axial length on the outside of said reduction gear means is different from the number of threads per unit axial length on the inside of said reduction gear means to thereby provide a reduction gear effect.

2. The device as described in claim 1 and wherein said elongated member includes a nut to be adapted to be moved longitudinally with respect to the central axis of the tube while remaining rotationally stationary with respect to said housing means.

3. The device as described in claim 2 and wherein said housing means includes securing means for engaging said nut to enable it to move longitudinally with respect to the central axis of the tube while retaining said elongated member rotationally stationary with respect to the central axis of the tube.

4. The device as described in claim 3 and wherein said securing means comprises pin means; and, said nut comprises a head having a groove for insertion of said pin means to thereby maintain said elongated member rotationally stationary with respect to the central axis of the tube when said elongated member moves longitudinally with respect to the central axis of the tube.

5. The device as described in claim 2 and further comprising:

vice means for securing the tube to said elongated member to maintain the movement of the tube coincidental with the movement of said elongated member.

6. The device as described in claim 1 and wherein the tube is a capillary tube; and, said housing means includes means for securing said housing to a chamber to thereby enable fluid to flow through said capillary tube into the chamber.

7. The device as described in claim 6 and wherein said means for securing said housing means includes an extended tubular member having a hollow axial bore through the central axis thereof through which said capillary tube is inserted with the tip of said capillary tube extending beyond the end of said tubular member to thereby enable fluid to flow through the end of said capillary tube into the chamber.

8. The device described in claim 7 and wherein said chamber has a threaded bore and said means for securing said housing to said chamber comprises a threaded outer surface on said extended tubular member for securing said housing to said chamber.

9. A device for controlling the movement of a capillary tube comprising:

housing means including a threaded interior bore;

an elongated member having a central axis and adapted for holding the capillary tube in said central axis, said elongated member having an outer threaded surface;

displacing means threadedly coupled between said housing and said elongated member having a number of threads per unit axial length on the outside thereof which is different from the number of threads per unit axial length on the inside thereof to thereby provide a reduction gear effect; and wherein said housing includes securing means for engaging said elongated member to enable it to move longitudinally with respect to said central axis while retaining said elongated member rotationally stationary around said central axis with respect to said housing.

10. The device as described in claim 9 and wherein said elongated member includes a nut adapted to be engaged by said securing means for enabling said nut to move longitudinally with respect to said central axis while retaining said nut rotationally stationary, around said central axis, with respect to said housing.

11. The devices described in claim 10 and wherein said securing means comprises pin means; and said nut comprises a head having a groove for insertion therein of said pin means to thereby maintain said elongated member rotationally stationary with respect to the central axis of said capillary tube wherein said elongated member moves longitudinally with respect to said central axis while retaining said nut rotationally stationary around said central axis with respect to said housing.

12. The device as described in claim 11 and wherein said displacing means comprises reduction gear means for providing displacement of said elongated member which is in linear proportion to the angular rotation of said reduction gear.

13. The device as described in claim 12 and wherein said housing means includes a threaded interior bore; and said reduction gear means has an outer threaded surface adapted to be threaded into said threaded bore of said housing means, and a threaded interior bore; and said elongated member has an outer threaded surface adapted to be threaded into said threaded interior bore of said reduction gear means.

14. A device for controlling the movement of a cylindrical object comprising:

housing means having securing means and a threaded interior bore;

an elongated member having a central bore and adapted for holding the cylindrical object in said central bore, said elongated member having an outer threaded surface;

reduction gear means coupled between said housing means and said elongated member for providing displacement of said elongated member in linear proportion to the angular rotation of said reduction gear means, wherein the number of threads per unit axial length on the outside of said reduction gear means is different from the number threads per unit axial length on the inside of said reduction gear means to thereby provide a reduction gear effect.

15. The device as described in claim 14 and wherein said securing means comprises pin means; and, said elongated member includes a nut having a head with a groove for insertion therein of said pin means to thereby maintain said nut rotationally stationary with respect to the central axis of said central bore of said elongated member while enabling said nut to move longitudinally with respect to the central axis of said central bore of said elongated member.

16. The device as described in claim 14 and wherein said securing means engages said elongated member to enable it to move longitudinally with respect to said central bore while retaining said elongated member rotationally stationary around said central bore with respect to said housing.

* * * * *